United States Patent [19]

Finn et al.

[11] Patent Number: 4,527,528

[45] Date of Patent: Jul. 9, 1985

[54] FUEL INJECTION SYSTEM

[75] Inventors: Charles E. Finn, Rochester, N.Y.; Allan M. Ruckey, Pontiac, Mich.; David C. Shuler, Rochester, N.Y.

[73] Assignee: General Motors Corporation, Detroit, Mich.

[21] Appl. No.: 320,502

[22] Filed: Nov. 12, 1981

[51] Int. Cl.[3] ..... F02M 41/02

[52] U.S. Cl. ..... 123/447; 123/456; 123/460

[58] Field of Search ..... 123/447, 446, 456, 457, 123/460, 461

[56] References Cited

U.S. PATENT DOCUMENTS

| | | | |
|---|---|---|---|
| 3,511,270 | 5/1970 | Fehrenbach | 123/460 |
| 3,827,409 | 8/1974 | O'Neill | 123/456 |
| 4,204,507 | 5/1980 | Casey | 123/457 |
| 4,205,639 | 6/1980 | Ito et al. | 123/456 |

OTHER PUBLICATIONS

"1982 Pontiac Phoenix & 6000 Models Service Manual", pp. 6E2-2 through 6E2-4—FIG. 6E2-4.

"1981 Cadillac Advance Service Information", pp. 6C-143 and 6C-144—FIG. 6C-163.

*Primary Examiner*—Carl Stuart Miller

*Attorney, Agent, or Firm*—C. K. Veenstra

[57] ABSTRACT

A single pressure regulator controls fuel flow in series through a pair of throttle body injection assemblies adapted to be mounted in remotely spaced locations on an engine intake manifold. The pressure regulator is located in the second assembly, while the first assembly has an accumulator which minimizes pressure fluctuations. The injector in the second assembly has a greater fuel flow capacity than the injector in the first assembly to compensate for the pressure drop caused by the flow restriction between the two assemblies and permit the injectors to provide equal fuel delivery.

1 Claim, 1 Drawing Figure

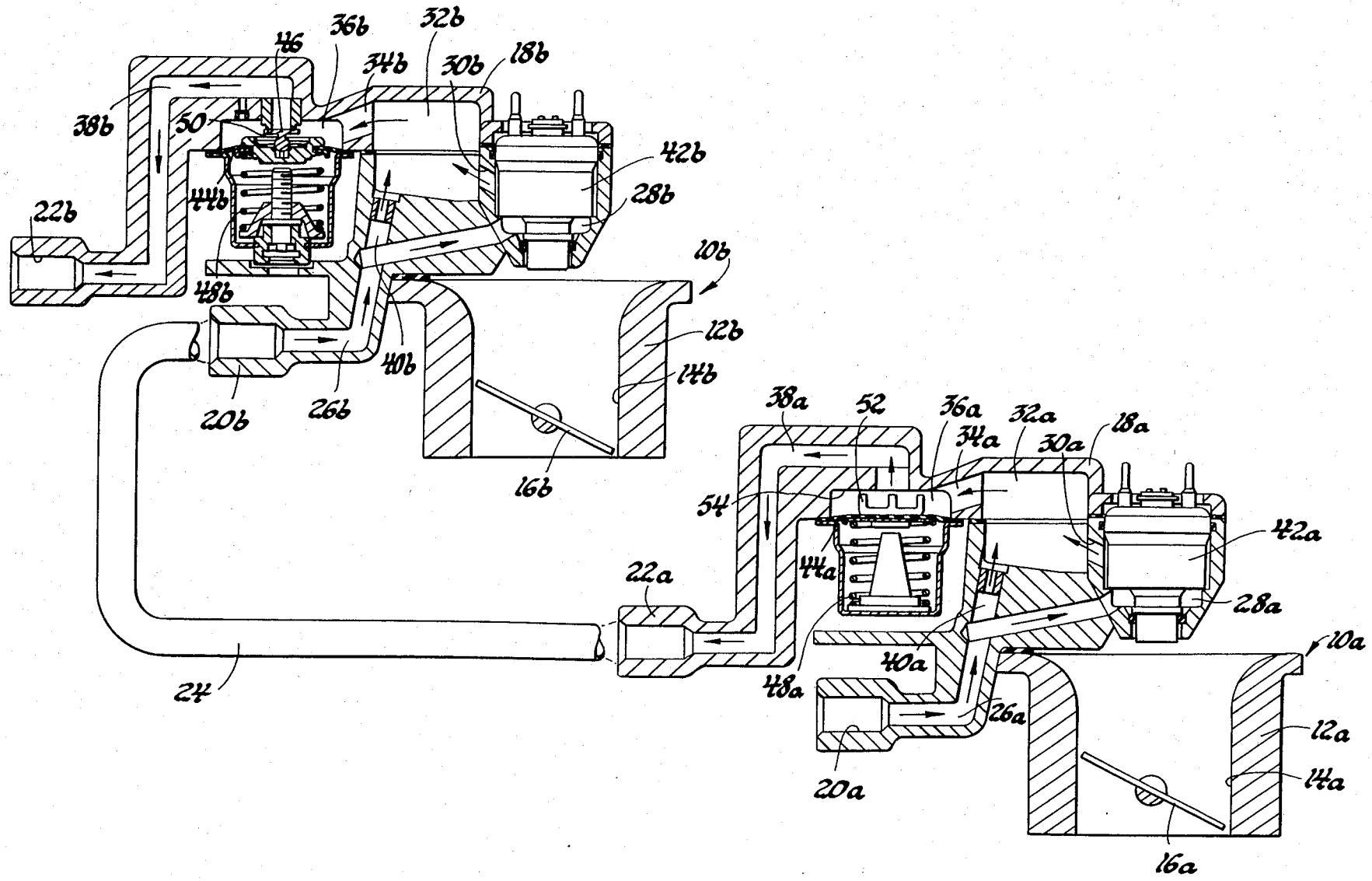
10a
12a
14a
16a
18a
20a
22a
24
26a
28a
30a
32a
34a
36a
38a
40a
42a
44a
46a
48a
50
52
54
10b
12b
14b
16b
18b
20b
22b
26b
28b
30b
32b
34b
36b
38b
40b
42b
44b
46b
48b

FUEL INJECTION SYSTEM

TECHNICAL FIELD

This invention relates to a fuel injection system having injectors which deliver fuel to spaced locations of an engine induction system.

BACKGROUND

Certain automotive engines are equipped with a low pressure fuel injection system having a fuel injector which delivers fuel in timed pulses into the engine air induction passage above the throttle. Such a fuel injection system, known as a throttle body injection system or a TBI system, has been provided both in a one barrel assembly in which all of the air flow to the engine is controlled by a single throttle and a single injector delivers fuel above the throttle, and in a side-by-side two barrel assembly in which each of the parallel air induction passages is controlled by a throttle and has an injector delivering fuel above the throttle.

In a system of this nature, fuel flow is conventionally controlled by varying the duration of the timed fuel delivery pulses: when increased fuel delivery is desired, the injector is energized for a longer period of time to increase the duration of the fuel delivery pulse; when decreased fuel delivery is desired, the injector is energized for a shorter period of time to decrease the duration of the fuel delivery pulse. It will be appreciated, of course, that variations in the pressure of the fuel supplied to the injector also will affect fuel delivery by the injector. Accordingly, in order to provide predictable and repeatable fuel delivery by the injector in response to the duration of the fuel delivery pulses, the fuel supply pressure is controlled in a selected manner, generally by maintaining a constant supply pressure.

Thus for example, in the one barrel TBI assembly, the injector is mounted in an injector chamber, and fuel flows through the injector chamber to a nearby pressure regulator which maintains a substantially constant supply pressure in the injector chamber. Similarly, in the two barrel TBI assembly, the injectors are mounted in separate injector chambers, and fuel flows in parallel through the injector chambers to a nearby pressure regulator which maintains the same substantially constant supply pressure in the two injector chambers.

It should be noted that in addition to controlling the supply pressure to the injectors, the TBI pressure regulator also allows a continuous circulation of fuel through the TBI assembly. The circulating fuel cools the injectors and other portions of the assembly to prevent formation of fuel vapor which might otherwise affect fuel delivery by the injectors.

In another embodiment of the TBI system, it is desired to mount two single barrel TBI assemblies at remotely spaced locations on an engine intake manifold. In a system of this nature, a single pressure regulator necessarily would be located remotely from at least one of the injector chambers and therefore could not prevent fluctuations in the supply pressure for that injector. On the other hand, a pair of pressure regulators each located closely adjacent an associated injector chamber could prevent fluctuations in the supply pressure for the injectors, but the supply pressure for the two injectors would not necessarily be the same and most of the fuel would circulate through and cool only the assembly with the lower supply pressure.

SUMMARY OF THE INVENTION

This invention provides a fuel injection system suitable for delivering fuel at remotely spaced locations and having a single pressure regulator controlling the fuel supply pressure to a pair of injectors, and in which adequate cooling is assured while supply pressure fluctuations are minimized.

In a fuel injection system according to this invention, fuel is supplied in series through the injector chambers and then to a pressure regulator located closely adjacent the second injector chamber. The pressure regulator maintains the desired fuel supply pressure in the injector chambers and serves as an accumulator to minimize pressure fluctuations which might otherwise occur in the second injector chamber. A separate accumulator is located closely adjacent the first injector chamber to similarly minimize pressure fluctuations in the first injector chamber.

It will be realized that, in this system, a long or restricted flow path between the first and second injector chambers would create a difference in the supply pressures in the injector chambers, with the second injector chamber having a lower supply pressure than the first injector chamber. In that situation, two otherwise identical injectors would deliver different amounts of fuel when energized for any selected period of time. To allow the two injectors to provide equal fuel delivery under such circumstances, this invention contemplates that the second injector would have a slightly greater flow capacity than the first injector, thereby compensating for its lower supply pressure and providing the same fuel delivery as the first injector.

The details as well as other features and advantages of this invention are set forth in the remainder of the specification and are shown in the accompanying drawing.

SUMMARY OF THE DRAWING

The sole FIGURE of the drawing schematically illustrates a throttle body injection system employing this invention.

BEST MODE FOR CARRYING OUT THE INVENTION

Referring to the drawing, the throttle body injection system includes a pair of throttle body injection or TBI assemblies 10*a* and 10*b*. Each TBI assembly includes a throttle body 12*a*, 12*b* having an air induction passage 14*a*, 14*b* forming a portion of the engine air induction system and controlled by a throttle 16*a*, 16*b*.

Fuel bodies 18*a*, 18*b* are mounted on throttle bodies 12*a*, 12*b*. Fuel body 18*a* includes an inlet 20*a* adapted to receive fuel from a low pressure supply pump and also includes a fitting 22*a* connected to a pipe 24. Fuel body 18*b* similarly includes a fitting 20*b* which receives fuel from pipe 24 and also includes an outlet 22*b*.

Within each fuel body 18*a*, 18*b*, a passage 26*a*, 26*b* directs fuel to an injector chamber 28*a*, 28*b*, and a passage 30*a*, 30*b* opens from the injector chamber 28*a*, 28*b* to an intermediate chamber 32*a*, 32*b*.

In fuel body 18*a*, a passage 34*a* opens from intermediate chamber 32*a* to an accumulator chamber 36*a* which discharges through a passage 38*a* to fitting 22*a*. Similarly, in fuel body 18*b* a passage 34*b* opens from intermediate chamber 32*b* to a pressure regulator chamber 36*b* which discharges through a passage 38*b* to outlet 22*b*.

Within each fuel body 18*a*, 18*b*, a bypass 40*a*, 40*b* opens from passage 26*a*, 26*b* to intermediate chamber 32*a*, 32*b*, thereby allowing any fuel vapor present in passages 26*a*, 26*b* to bypass injector chambers 28*a*, 28*b*.

From the foregoing, it may be seen that the fuel flow path extends from inlet 20*a* through passage 26*a*, injector chamber 28*a*, passage 30*a*, intermediate chamber 32*a*, passage 34*a*, accumulator chamber 36*a*, passage 38*a*, fitting 22*a*, pipe 24, fitting 20*b*, passage 26*b*, injector chamber 28*b*, passage 30*b*, intermediate chamber 32*b*, passage 34*b*, pressure regulator chamber 36*b* and passage 38*b* to outlet 22*b*. Fuel circulating through this path cools fuel bodies 18*a*, 18*b* to maintain the TBI system below temperatures where fuel vapor might otherwise be generated.

Injectors 42*a*, 42*b* are mounted in injector chambers 28*a*, 28*b* and may be energized in a conventional manner to deliver fuel in timed pulses from injector chambers 28*a*, 28*b* into the region of air induction passages 14*a*, 14*b* above throttles 16*a*, 16*b*. In order that injectors 42*a*, 42*b* may deliver a predictable and repeatable amount of fuel to air induction passages 14*a*, 14*b* in response to variations in the duration of the timed pulses, a desired supply pressure is established in injector chambers 28*a*, 28*b*. To this end, pressure regulator chamber 36*b* is closed by a pressure regulator diaphragm 44*b* which carries a pressure regulator valve 46. A spring 48*b* biases pressure regulator diaphragm 44*b* and valve 46 upwardly toward engagement of valve 46 with a valve seat 50 formed about the portion of the fuel flow path opening from pressure regulator chamber 36*b* to passage 38*b*. Should the supply pressure in pressure regulator chamber 36*b*, and thus in injector chambers 28*b*, 28*a*, rise above the desired supply pressure, diaphragm 44*b* is displaced downwardly against the bias of spring 48*b* to pull valve 46 away from valve seat 50; additional fuel is thereby permitted to flow from pressure regulator chamber 36*b* to passage 38*b* to reduce the supply pressure in pressure regulator chamber 36*b* and injector chambers 28*b*, 28*a*. Should the supply pressure in pressure regulator chamber 36*b* and injector chambers 28*b*, 28*a* fall below the desired supply pressure, spring 48*b* displaces diaphragm 44*b* upwardly to push valve 46 toward valve seat 50; fuel flow from pressure regulator chamber 36*b* to passage 38*b* is accordingly reduced to increase the supply pressure in pressure regulator chamber 36*b* and injector chambers 28*b*, 28*a*. Under steady state conditions with the desired pressure in pressure regulator chamber 36*b*, diaphragm 44*b* will position valve 46 somewhat away from seat 50, allowing a continuous flow of fuel through fuel bodies 18*a*, 18*b*.

It will be appreciated that when injector 42*b* is energized to deliver fuel from injector chamber 28*b* to air induction passage 14*b*, injector chamber 28*b* will tend to experience a momentary reduction in pressure. Spring 48*b* and diaphragm 44*b* respond to that momentary pressure reduction, not only to push valve 46 toward valve seat 50, but also to reduce the volume of pressure regulator chamber 36*b*. The fuel thus displaced from pressure regulator chamber 36*b* replaces the fuel delivered from injector chamber 28*b* and thereby minimizes the momentary reduction in pressure in injector chamber 28*b*. When injector 42*b* is deenergized, pressure regulator diaphragm 44*b* is again slightly displaced downwardly against the bias of spring 48*b* to position valve 46 somewhat away from seat 50.

Although the pressure regulator apparatus is located remotely from injector chamber 28*a*, it has been found effective to generally maintain the desired supply pressure in injector chamber 28*a*. However, due to its remote location, the pressure regulator apparatus does not adequately minimize the momentary reduction in pressure in injector chamber 28*a* which occurs when injector 42*a* is energized to deliver fuel into induction passage 14*a*. Accordingly, accumulator chamber 36*a* is closed by an accumulator diaphragm 44*a* biased upwardly by a spring 48*a*. A stop 52 limits upward movement of accumulator diaphragm 44*a* but does not restrict flow from accumulator chamber 36*a* to passage 38*a*. The fuel pressure in accumulator chamber 36*a* is normally adequate to displace diaphragm 44*a* against the bias of spring 48*a*, holding stop 52 away from the upper surface 54 of accumulator chamber 36*a*. However, when injector 42*a* is energized to deliver fuel from injector chamber 28*a*, the momentary reduction in pressure in injector chamber 28*a* is sensed in accumulator chamber 36*a*, and spring 48*a* pushes accumulator diaphragm 44*a* upwardly, reducing the volume of accumulator chamber 36*a*. The fuel thus displaced from accumulator chamber 36*a* replaces the fuel delivered from injector chamber 28*a* and thereby minimizes the momentary reduction in pressure in injector chamber 28*a*. When injector 42*a* is deenergized, accumulator diaphragm 44*a* is again displaced downwardly against the bias of spring 48*a*.

It will be appreciated that although a substantially constant supply pressure is maintained in injector chambers 28*a*, 28*b*, the restriction created by the long fuel flow path between injector chamber 28*a* and injector chamber 28*b* will cause the pressure in injector chamber 28*b* to be slightly lower than the pressure in injector chamber 28*a*. Accordingly, injector 42*b* has a fuel flow capacity slightly greater (for example, three percent greater) than the fuel flow capacity of injector 42*a*. Thus even though the fuel pressure in chamber 28*b* is slightly less than the fuel pressure in injector chamber 28*a*, injectors 42*a* and 42*b* deliver fuel equally to induction passages 14*a* and 14*b*.

The embodiments of the invention in which an exclusive property or privilege is claimed are defined as follows:

1. A system for delivering fuel into an engine induction region, said system comprising means defining a fuel flow path including in series a fuel inlet followed by a first fuel injector chamber followed by a remotely spaced second fuel injector chamber followed by a pressure regulator chamber followed by a fuel outlet, said fuel flow path being adapted to circulate fuel from said inlet through said chambers to said outlet, said means further defining an accumulator chamber connected to said first injector chamber, said apparatus also comprising fuel injectors adapted to deliver fuel in timed pulses from said injector chambers into said induction region, and an accumulator diaphragm defining a portion of said accumulator chamber, said accumulator diaphragm being effective to reduce the volume of said accumulator chamber to thereby minimize a reduction in the pressure in said accumulator chamber and said first injector chamber, said fuel flow path also including a valve seat formed about the portion of the fuel flow path opening from said pressure regulator chamber to said outlet, and said system further comprising a valve member controlling fuel flow through said valve seat, and a pressure regulator diaphragm carrying said valve member and defining a portion of said pressure regulator chamber, said pressure regulator diaphragm being effective to position said valve member to control fuel flow through said valve seat in a manner which will maintain a substantially constant pressure in said fuel flow path upstream of said valve seat, said pressure regulator diaphragm being further effective to reduce the volume of said pressure regulator chamber to thereby minimize a reduction in the pressure in said pressure regulator chamber and said second injector chamber, said system thereby effecting a substantially constant pressure in said injector chambers and minimizing the momentary reduction in pressure in said injector chambers which would otherwise occur as said injectors deliver fuel into said induction region, and wherein the injector associated with said second injector chamber has a greater flow capacity than the injector associated with said first injector chamber to compensate for a pressure gradient along said flow path from said accumulator chamber to said second injector chamber and thereby provide equal fuel delivery by said injectors.

* * * * *